US005195427A

United States Patent [19]

Germano

[11] Patent Number: 5,195,427

[45] Date of Patent: Mar. 23, 1993

[54] SUCTION DEVICE TO CREATE A VACUUM IN CONTAINERS

[76] Inventor: Maina Germano, Via Rossini 3, 20090 Limito (Milano), Italy

[21] Appl. No.: 854,245

[22] Filed: Mar. 20, 1992

[30] Foreign Application Priority Data

Apr. 3, 1991 [IT] Italy ..... MI91A000927
Feb. 14, 1992 [IT] Italy ..... MI92U000129

[51] Int. Cl.[5] ..... B65B 31/04; B65D 51/16; A23B 7/00

[52] U.S. Cl. ..... 99/472; 99/646 C; 141/65; 206/524.8; 215/260; 215/262; 220/231

[58] Field of Search ..... 99/472, 476, 646 C, 99/646 R; 141/65; 206/524.8; 215/260, 262, 311; 220/231; 417/437, 239, 555.1, 550

[56] References Cited

U.S. PATENT DOCUMENTS

| | | | |
|---|---|---|---|
| 303,014 | 8/1884 | Hoyt | 99/472 |
| 1,572,190 | 2/1926 | Don | 53/510 |
| 1,621,132 | 3/1927 | Reinbold | 99/472 |
| 2,049,872 | 8/1936 | Sera | 141/65 |
| 2,648,474 | 8/1953 | Crook | 141/65 |
| 2,669,176 | 2/1954 | Lazerus | 417/239 |
| 4,051,971 | 10/1977 | Saleri et al. | 215/260 |
| 4,287,819 | 9/1981 | Emerit | 215/260 |
| 4,362,095 | 12/1982 | Wheatley | 220/231 |
| 4,615,361 | 10/1986 | Bartle, Sr. | 417/550 |
| 4,989,745 | 2/1991 | Schneider | 215/260 |

FOREIGN PATENT DOCUMENTS

| | | | |
|---|---|---|---|
| 0212201 | 3/1987 | European Pat. Off. | 141/65 |
| 95335 | 6/1923 | Fed. Rep. of Germany | 99/472 |
| 567311 | 12/1932 | Fed. Rep. of Germany | 99/472 |
| 592574 | 5/1959 | Italy | 99/472 |

*Primary Examiner*—Timothy F. Simone
*Attorney, Agent, or Firm*—Notaro & Michalos

[57] ABSTRACT

A suction device suitable to create a vacuum in containers particularly for the preservation of food in a vacuum, consisting of a casing formed by two coupled halves (4, 5) that contain an electric motor (7) that actuates a suction pump formed by a cylinder-piston unit (14, 15), by means of a reducer group formed by a pinion (17) force-fit onto the shaft (16) of the motor (7) and by a crown gear (19) having an eccentric (37) which actuates a connecting rod (23) connected to the piston (15). The device has at one end a holed tip (34) which can be pluged directly in the seating of the valve (3) that is provided on the container, so that it can be used with one hand only.

19 Claims, 4 Drawing Sheets

SUCTION DEVICE TO CREATE A VACUUM IN CONTAINERS

FIELD AND BACKGROUND OF THE INVENTION

The present invention refers to a suction device suitable to create a vacuum in containers, particularly for the preservation in a vacuum of food and of eprishable materials in general.

It is well know that almost every type of food, either solid, semi-solid or liquid, tends to deteriorate rapidly when it is in contact with air, due to the aggression of air components, oxygen in particular.

The "oxidization" of food can be prevented by preserving it in a vacuum.

Although there are suction devices to create a vacuum in containers, this technique to preserve food is not very widespread, on the contrary it is absolutely unknown to most consumers, at the domestic level, due to the drawbacks of the suction systems, that will be briefly illustrated.

First of all, the known suction devices are very expensive, bulky and heavy, for this reason they must be fixed installations, at least during use. This equipment, in fact, is fixed to the wall or leaned on a flat surface and is connected to a valve of the container in which the vacuum must be created, by means of a flexible tube.

As far as the internal structure of such equipment is concerned, is comprise an electric motor, on whose exit shaft an eccentric is mounted that directly actuates the piston of a suction pump whose shaft is perpendicular to the axis of the motor shaft. The position of the motor and of the pump plus the direct transmission between these elements require a high power, and therefore an over-dimensioning of the whole equipment.

Although the problem of making the above equipment portable and handy, in order to increase is usefulness, is strongly felt, up to now this could not be realized, meanly due to the technical solutions adopted in the devices presently on the market.

The applicant knows about a "portable" device consisting of a manual pump that presents the clear drawback of not reaching acceptable vacuum levels and of requiring the user to grip it with both hands.

A device for domestic use is also known, being suitable to create a vacuum in containers and comprising a casing which houses an electric motor, a suction pump provided with a tip connected to a valve located on the container cover.

This devices is provided with electronic means suitable to establish the vacuum degree inside the container by measuring the motor absorption power and comprising transmission devices in which a bevel gear pair is arranged to transmit motion from the motor to an eccentric actuating the pump.

This device is illustrated in the Italian Patent Application MI91 A 000927 filed by the same applicant on Apr. 03, 1991.

SUMMARY OF THE INVENTION

The aim of the present invention is to improve the previously illustrated devices, supplying a suction device that can be used with one hand only, that is capable of creating a high vacuum in containers.

In the suction device according to the invention, between the motor and the suction pump, a reducer group is installed which is formed by a pinion force-fit onto the motor shaft and by a crown gear with an eccentric that actuates a connecting rod connected to the piston of the suction pump.

According to a particularly preferred embodiment of the invention, the axis of the crown gear is perpendicular to the axis of the pinion, therefore motor and pump can be located on the same axis and the device substantially has a straight line shape.

According to a possible different embodiment, the pinion force-fit onto the motor shaft may be replaced by a worm, whose complanate axis is perfectly parallel to the pump axis.

In the front part of the device an interchangeable and elastic tip is provided that can perfectly fit a valve seating provided in a container in which a vacuum must be created. The tip is housed in a transparent removable little cup for collecting the eventual condensation during the use of the device.

The device thus conceived can be used with one hand, putting the tip directly into the valve seating provided in the container and pushing a pushbutton switch conveniently located near the end of the device opposite to the tip with the thumb or the forefinger of the same hand. On the housing of the device a set of LEDs of different colors can be installed, whose lighting is controlled by a signal from the motor which, for instance, indicates the functioning of the device and the reached degree of vacuum.

In alternative or in addition, a mechanical vacuum measuring device may be advantageously arranged and directly connected to the suction tip.

The electric motor can be powered by an electrical outlet, by means of an electric cable with related plug, that extends from the device.

According to an advantageous different embodiment, the device can work with low voltage supplied by a rechargeable battery incorporated therein.

The device according to the invention may be used to blow in air, instead of suckering it out and this will not involve substantial changes in what has been previously illustrated and it may be easily accomplished by actuating the pump as a compressor.

BRIEF DESCRIPTION OF THE DRAWINGS

Further characteristics of the invention will be clear from the following detailed description, referring to a purely illustrative therefore in no ways limitative embodiment, illustrated in the attached drawings, in which.

DESCRIPTION OF THE PREFERRED EMBODIMENTS

Figure 1:
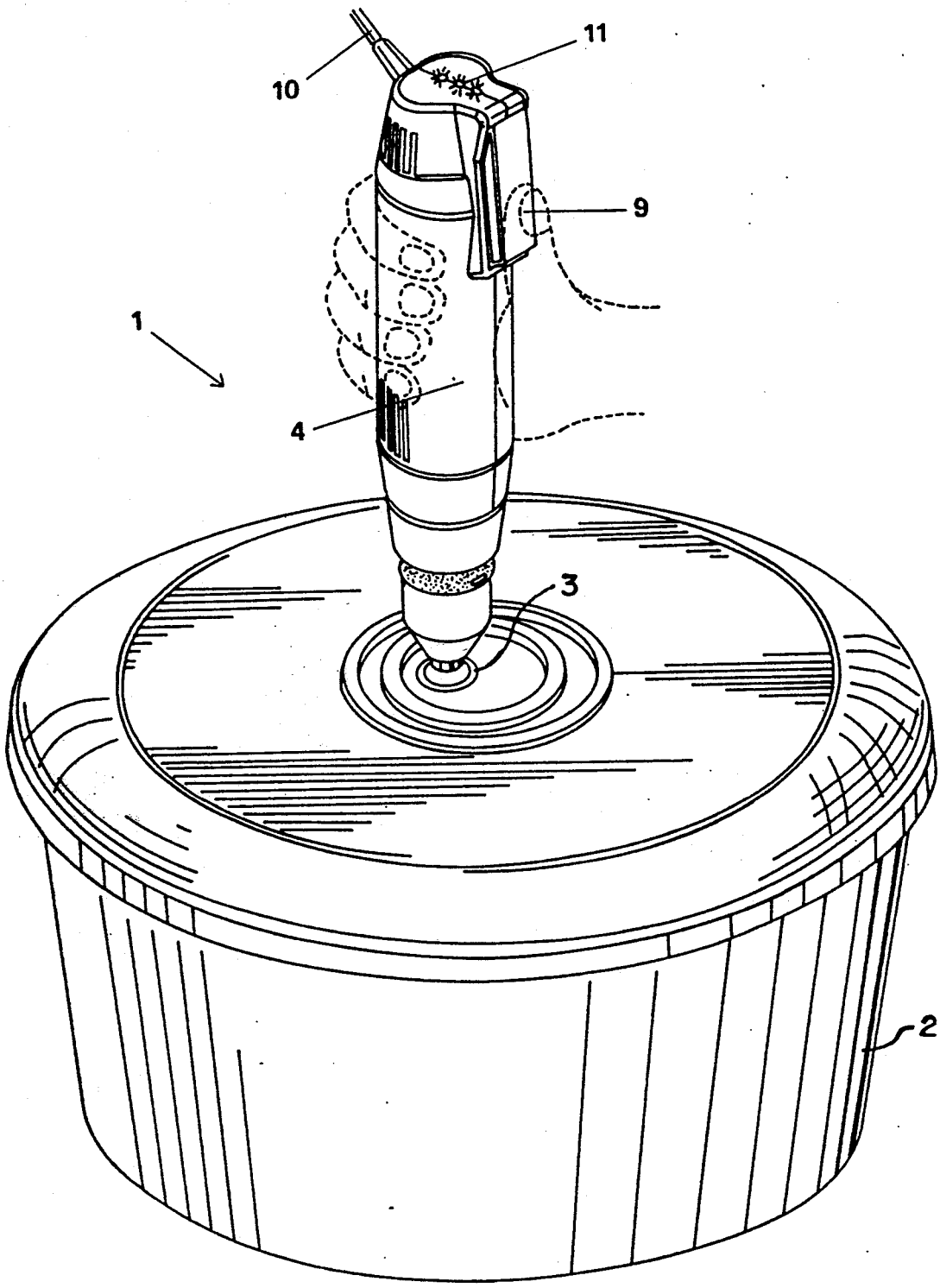
FIG. 1 is an perspective view showing the suction device according to the invention, during its use to create a vacuum in a container.
Figure 2:
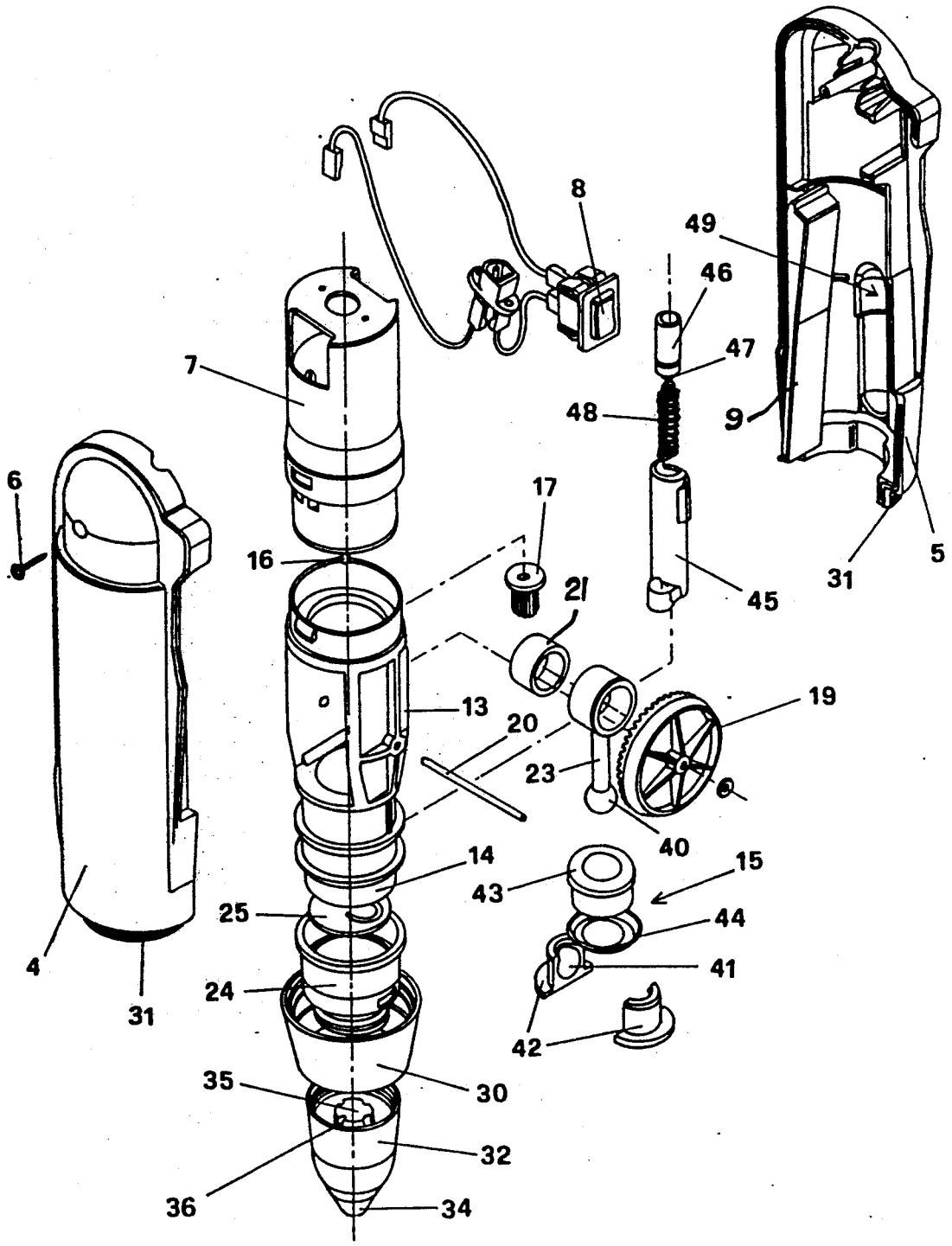
FIG. 2 is an exploded perspective view of a preferred embodiment of the device of FIG. 1.
Figure 4:
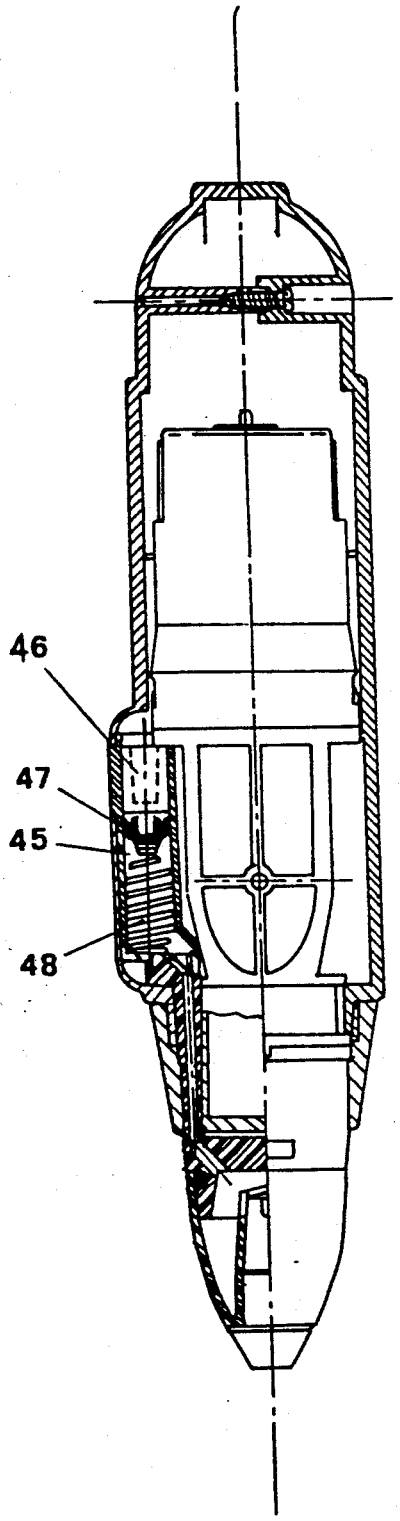
FIG. 4 is a further section of the device.
Figure 3:
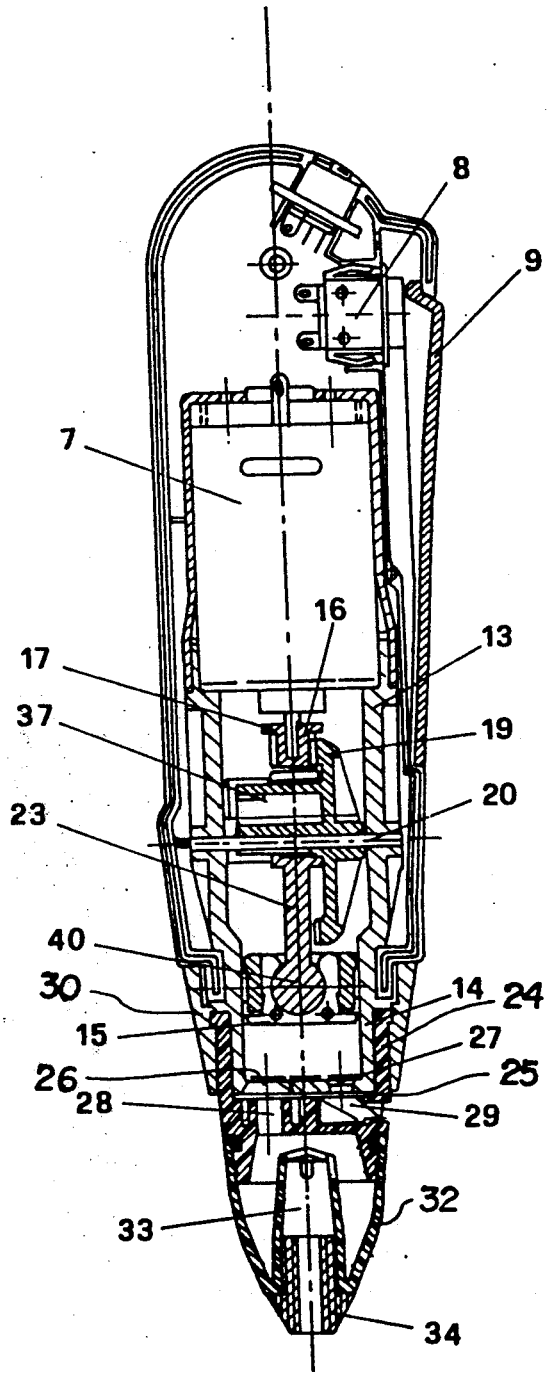
FIG. 3 is a mid-section taken from the device according to the invention.

With reference to FIGS. 1 to 3, the device according to the invention has been indicated as a whole with reference number 1 and it is shown in FIG. 1 applied to a valve 3 of a container 2, in which a vacuum must be created.

As better shown in the exploded view of FIG. 2, the suction device 1 comprises an outer casing formed by two substantially identical halves 4, 5, that are assembled with screws 6. Inside such casing, in the upper part, there is an electric motor 7, operated by a press switch 8, actuated by a pivoted key 9. In these figures a power cable 10 is partially shown, in case the motor 7 is fed by line current. It is evident, however, that the device can be fed by a battery eventually rechargeable by the line current. In the figures three LEDs 11 of different colors are also shown whose status is determined by the current absorption of the motor 7 and which serve to signal the degree of vacuum reached in the container during the functioning of the device. As the motor strains against the ever increasing vacuum, the motor draws or absorbs more current and this lights the LEDs in sequences, showing the corresponding increase in vacuum.

Below motor 7 a support cage 13 is provided to hold the cylinder 14 of a pump and a reduction gear, which will be described and which transmits reciprocating motion to a piston 15.

On the outgoing end of the shaft 16 of the motor 7, a motor gear or conical pinion 17 is force-fit, that may be made integral with an impeller (not shown) for the cooling of the motor. The pinion 17 is engaged on a crown gear 19 rotatably mounted on a pivot 20 held by the cage 13. Inside the crown gear 19 an hallow eccentric 37 is provided as shown in FIG. 3, which carries a lubricating bushing 21 therein. Around the eccentric 37, there is the head of a connecting rod 23, whose free end supports the piston 15.

In particular, said free end has the shape of a sphere 40 located in semispheric seatings 41 of two symmetrical pads 42, opposed, to the piston. The pads 42 are fixed to a bush 43 inserted on them upon interposition of a gasket 44.

In the embodiment illustrated in FIGS. 1 to 3, the pivot 20, that is the axis of the crown gear 19, is perpendicular to the motor shaft 16, and the piston-cylinder unit of the suction pump is perfectly aligned with the axis of motor 7, therefore the device is substantially straight-lined. However, it is evident that, keeping the position of pivot 20, unchanged, the axis of the cylinder 4 can be inclined, for instance up to 90° with respect to the motor shaft 16, on a plane perpendicular to the plane of the sheet in FIG. 3.

Below cylinder 14 there is a valve body 24, upon interposition of a diaphragm valve 25. At the bottom of cylinder 14 there are two openings 26 and 27 connected, through the diaphragm valve 25, with a suction duct 28 and an exhaust duct 29 of the valve body 24, respectively.

As shown in FIG. 3, the valve body 24, the diaphragm valve 25 and the cylinder 14 (the latter might also be integral with cage 13) are assembled by means of a ring nut 30, threaded on a thread 31 made externally at the lower ends of two halves 4, 5 of the device casing.

To the body valve 24 a terminal cap 32 is fixed, e.g. by means of a bayonet joint or by screwing, with a locking ring interposed therebetween. This terminal cap, preferably in transparent material, has an internal seat 33 for the press fit of a tip 34 in flexible material, such as rubber. This tip will engage the seating of valve 3 provided on the container 2. In the embodiment shown in the attached figures, the tip 34 and the corresponding seating of valve 3 have the shape of a truncated pyramid.

The seat 33 of the terminal cap 32 has a solid end 35, as shown in the exploded view of FIG. 2, and side openings 36, through which the air sucked from container 2 is forced during the functioning of the device. In this way, the possible condensation is collected in the terminal cap 32 and drained by removing the cap from the device. The transparency of the cap 32 allows a visual check of the accumulation of condensation in the cap.

In alternative or in addition to the LEDs 11 signalling the vacuum degree, a mechanical indicator may be provided comprising a cylinder 45 whose lower end is connected, through a duct (not shown) obtained in the sidewall of the valve body 24, to the suction tip 34 and therefore, to the container 2, in which a vacuum is to be created. In the cylinder 45 a piston 46, with its gasket 47, is arranged and normally moved upwardly by a spring 48.

The vacuum obtained in the container 2 during the functioning of the device tends to move the piston 46 upwardly, in opposition to the action of the spring 48, whose position, visible through the transparent cylinder 45 and through an opening 49 arranged in one of the two halves 4 and 5, signals the degree of vacuum created.

The functioning of the suction device according to the invention is the following.

The device is grabbed with one hand, as schematically indicated in FIG. 1 (or putting the hand of the opposite side in order to t actuate the switch with the forefinger) and is located directly on a container 2 in which a vacuum must be created, by inserting the tip 34 in the seating of the corresponding valve 3 of the container. Pushing the pivoting key 9 the motor 7 is actuated, thus rotating the conical pinion 17 that transmits the rotation to the crown gear 19 which, through the eccentric 37, moves the connecting rod 23—piston 15 group by alternate motion. During the upward movement of the piston, that is the suction phase, the air sucked from the container passes through the openings 36, leaves the condensation and possible solid particles in the terminal cap 32 and enters the chamber of the cylinder passing through the duct 28 of the valve body 24, through the diaphragm valve 25 and through the opening 26 of the cylinder bottom. In this phase, the opening 27 in the cylinder bottom is obviously closed by the diaphragm valve 25. During the downward movement of the piston, the diaphragm valve 25 closes the opening 26 and opens the opening 27 of the cylinder bottom 14, thus sending to the exhaust the air present in the cylinder, through the duct 29 provided in the valve body 24.

As the vacuum increases in container 2, the current being drawn by the motor 7 increases, too and that is sensed by a suitable electronic circuit and is signalled to the user by the selective lighting of the Legs 11 indicating the degree of vacuum reached in the container.

In the case of a mechanical indicator, the degree of vacuum reached is signalled by the position of the piston 46, which moves as the vacuum in the container increases.

The transmission system between motor and suction pump according to the invention is particularly advantageous when the above elements are perfectly aligned, but can be conveniently used up to an inclination of 45° of these elements.

Even though in FIG. 1 a rigid container is shown, it is evident that the device according to the invention can be used with any other type of containers, for instance flexible ones, provided that they have a valve suitable to seat the tip 34, which has a convenient square section but, being interchangeable, could be substituted with a tip having a different transverse section, e.g. a round one.

Figure 5:
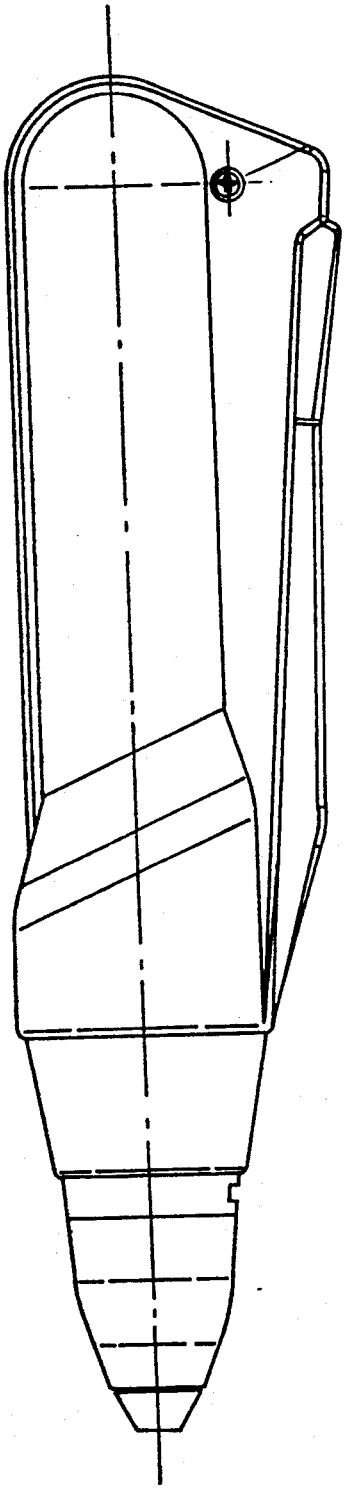
FIG. 5 is a side-view of a possible modified embodiment of the shape of the device shown in the previous figures.
Figure 6:
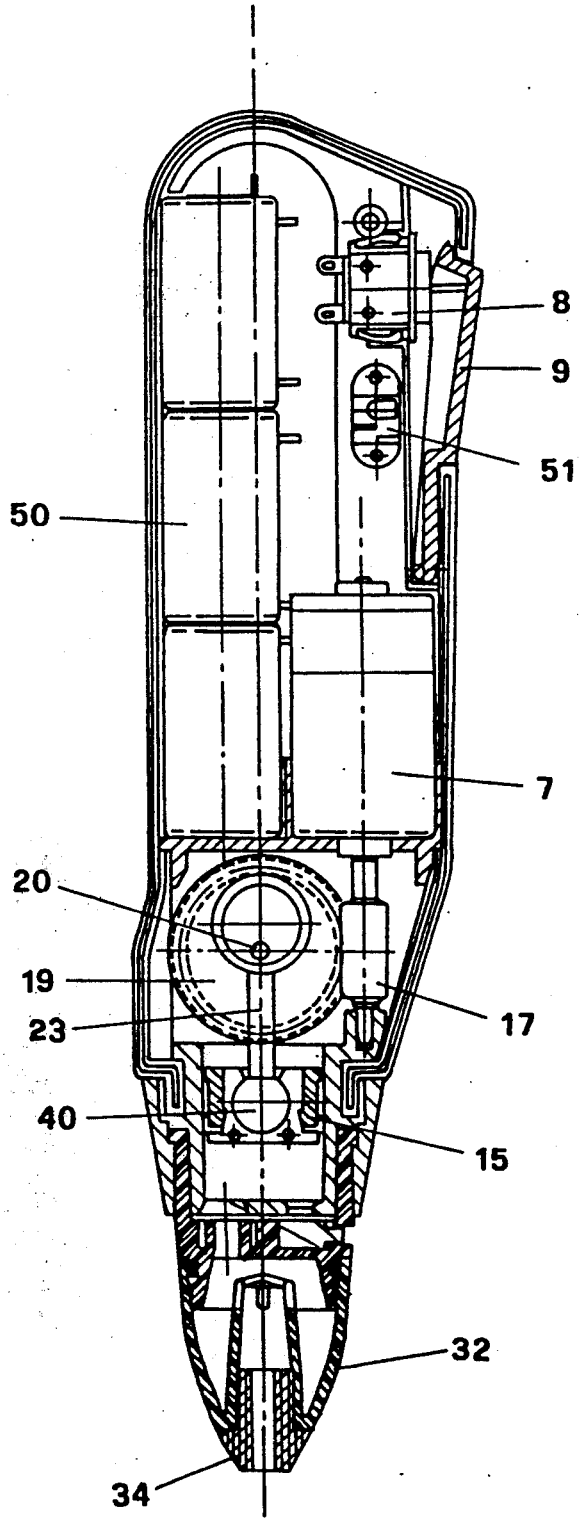
FIG. 6 is a mid-section of a different embodiment of the device according to the invention.

In FIG. 5 and 6 a possible different embodiment of the invention is shown, wherein, in the place of pinion 17, the motor gear is a worm, still indicated with reference number 17, is located offset with respect to the rod 23, actuating a crown gear 19 having a suitable profile.

According to this embodiment, feeder batteries 50 are provided, overlapped on a side of the device. A socket 51 for a battery recharge or, for connection to line current is provided.

Without any substantial change, but simply by inverting the functioning of the diaphragm valve 25, namely by actuating the pump as a compressor, it is possible to utilize the device according to the invention to blow in air, instead of sucking it.

Of course the invention is not limited to the embodiment described before and shown in the figures, but many modifications to its details can be carried out, which are within the reach of a technician in the art.

I claim:

1. A suction device for drawing a vacuum in a container (2) having a valve (3), comprising:

a casing (4,5);

an electric motor (7) having a shaft (16) and mounted in said casing;

a suction pump in said casing having a cylinder with an inlet and a piston movable in said cylinder (14,15), said suction pump being mounted in said casing at a location space from said electric motor;

a motor gear (17) force-fit onto said shaft;

a crown gear (19) meshed with said motor gear and mounted for rotation in said casing between said motor and said pump, said crown gear including an eccentric (37) eccentrically movable when said motor gear rotates to rotate said crown gear;

a connecting rod (23) operatively connected between said eccentric and said piston for reciprocal movement of said piston in said cylinder with rotation of said motor gear; and a hollow suction tip (34) adapted for engagement with the valve of the container, said tip being engaged with an end of the casing opposite from the motor and in communication with said inlet of said cylinder for drawing a vacuum from the container through the valve when the motor gear rotates.

2. A suction device according to claim 1, wherein said casing (4,5) has an axis, said crown gear (19) having an axis and said motor gear having an axis, the axis of said motor gear being parallel to the shaft of the motor and the axis of the crown gear being orthogonal to the axis of the motor gear.

3. A suction device according to claim 2, wherein the cylinder of the suction pump has an axis which is parallel to the axis of the shaft and to the axis of the casing.

4. A suction device according to claim 3, wherein the motor gear comprises a pinion meshed with the crown gear.

5. A suction device according to claim 3, wherein the motor gear comprises a worm gear.

6. A suction device according to claim 5, wherein the axis the worm gear is parallel to the axis of the cylinder.

7. A suction device according to claim 1, including a cage (13) in said casing, said motor (7) being fixed to said cage and a pivot (20) extending in said cage, said crown gear (19) being engaged on said pivot for rotation of said crown gear.

8. A suction device according to claim 1, wherein said eccentric (37) includes an internal cavity, and a lubricating bushing (21) in said cavity for lubricating an engagement between said eccentric and said connecting rod (23).

9. A suction device according to claim 1, wherein said piston comprises two pads (42,42) said connecting rod (23) having a spherical end (40) engaged between said pads and bush (43) engaged over said pads for holding said pads together against said spherical end.

10. A suction device according to claim 1, wherein said casing comprises two substantially equal casing halves (4,5) each having a thread (31) at an end thereof, a ring nut (30) engaged with the thread (31) of each casing half for locking said casing halves together, a valve body (24) in said ring nut and connected to said cylinder, and a diaphragm valve (25) engaged with said cylinder adjacent said inlet for admitting air into said cylinder from the inlet.

11. A suction device according to claim 1, wherein said tip (34) is interchangeable, said casing including a transparent terminal cap (32) at said end of said casing, said cap having a seat (33) for interchangeably receiving said tip (34) whereby condensate from air draw through said tip is visible in said cap.

12. A suction device according to claim 27, including a valve body (24) engaged with said cylinder and a diaphragm valve (25) engaged with said valve body for admitting air through said inlet, said terminal cap being fixed to said valve body.

13. A suction device according to claim 12, wherein said casing comprises a pair of substantially equal casing halves (4,5) each having a thread (31) and a ring nut (30) screwed to the thread for holding said casing halves together, said ring nut containing said valve body.

14. A suction device according to claim 1, wherein said tip comprises a truncated pyramid.

15. As suction device according to claim 1, including mechanical indicator means operatively connected to said cylinder, said mechanical indicator means indicating a degree of vacuum being drawn in the container and comprising an indicator cylinder (45) made at least partly of transparent material and mounted in said casing, said casing including an opening (49) through which at least transparent portions of said indicator cylinder are visible, an indicator piston (46) movable in said indicator cylinder and biasing means (48) for urging said indicator piston in a selected direction so that said indicator piston moves in said indicator cylinder depending on a degree of vacuum drawn in the container and present in the pump cylinder.

16. A suction device according to claim 1, including a switch (8) electrically connected to said motor (7) for activating said motor, and a pivot key (9) pivotly mounted to said casing, accessible from outside said casing and engagable with said switch, for switching said switch.

17. A suction device according to claim 16, including a plurality of Legs (11) electrically connected to said motor and lightable selectively depending on a current being drawn by said motor which is indicative of a level of vacuum drawn in the container.

18. A suction device according to claim 1, including rechargeable batteries in said casing and electrically connected to said motor for powering said motor.

19. A suction device according to claim 1, including an electrical current line connected to said motor for supplying electrical current to said motor.

* * * * *